United States Patent [19]

Kotzin et al.

[11] Patent Number: 4,882,751

[45] Date of Patent: Nov. 21, 1989

[54] SECURE TRUNKED COMMUNICATIONS SYSTEM

[75] Inventors: Michael D. Kotzin, Buffalo Grove; Kenneth J. Zdunek; Eric F. Ziolko, both of Schaumburg, all of Ill.

[73] Assignee: Motorola, Inc., Schaumburg, Ill.

[21] Appl. No.: 926,311

[22] Filed: Oct. 31, 1986

[51] Int. Cl.[4] ..... H04K 1/00

[52] U.S. Cl. ..... 380/9; 380/34; 380/49

[58] Field of Search ..... 380/1, 9, 33, 43; 455/15, 17, 53, 34; 379/63

[56] References Cited

U.S. PATENT DOCUMENTS

| | | | |
|---|---|---|---|
| 3,995,225 | 11/1976 | Horn | 375/1 |
| 4,012,597 | 3/1977 | Lynk, Jr. et al. | 455/53 |
| 4,167,700 | 9/1979 | Coe et al. | 380/33 |
| 4,174,502 | 11/1979 | Wilson et al. | 329/104 |
| 4,176,321 | 11/1979 | Horn | 380/9 |
| 4,197,502 | 4/1980 | Sumner et al. | 375/75 |
| 4,411,017 | 10/1983 | Talbot | 380/9 |
| 4,440,976 | 4/1984 | Bocci et al. | 380/1 |
| 4,553,262 | 11/1985 | Coe | 455/15 |
| 4,555,805 | 11/1985 | Talbot | 380/33 |
| 4,573,207 | 2/1986 | Smith et al. | 455/17 |
| 4,649,567 | 3/1987 | Childress | 455/34 |
| 4,672,601 | 6/1987 | Ablay | 379/63 |
| 4,692,945 | 9/1987 | Zdunek | 455/53 |

OTHER PUBLICATIONS

Instruction Manual 68P1043E50-B for a Trunked SYNTOR X RM Two-Way Radio (806-870 MHz at 35 watts) by Motorola, Inc.—1/15/81-PHI.

Instruction Manual 68P81066E60-A for a Trunked Radio System Central Controller (Privacy Plus Model T5004A and Smartnet Model T5076A) by Motorola, Inc.—3/15/86—PHI—Revision s SMR-51-64—9/30/86 and SMR-5089—4/30/86.

Instruction Manual 68P81063E20-0 for a Trunked System Central Interconnect Terminal (Models T4051 and T4052) by Motorola, Inc.—9-15-83—PHI.

Instruction Manual 68P81031E45-D for a MICOR Base and Repeater Station (851-866 MHz Transmit and 806-821 MHz Receive) by Motorola, Inc.—Revision SMR-4965 8/16/85.

Instruction Manual 68P81038E85-B for a MICOR Trunked Repeater (851-866 Transmit and 806-821 MHz Receive) by Motorola, Inc. 8/9/85—UP—Revisions SMR-5149—9/9/86 and SMR-4946—10/28/85.

*Primary Examiner*—Salvatore Cangialosi

*Attorney, Agent, or Firm*—Steven G. Parmelee

[57] ABSTRACT

A trunked communications system that accommodates encrypted secure communications. The system uses both non-encrypted message detectors and encrypted message detectors to assure that the trunked central control unit receives the signals it must receive in order to properly allocate and maintain channel assignments.

13 Claims, 8 Drawing Sheets

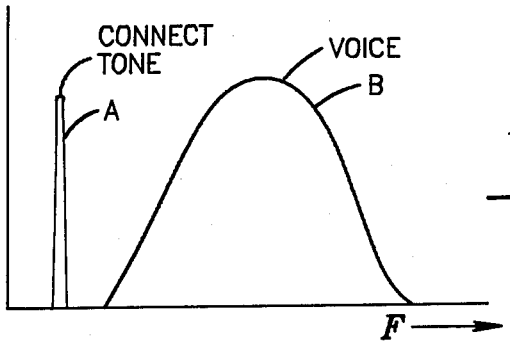
FIG. 1
—PRIOR ART—
SUBSCRIBER UNIT TO CENTRAL CONTROL UNIT
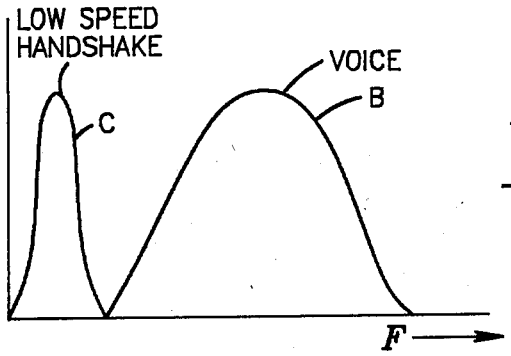
FIG. 2
—PRIOR ART—
CENTRAL CONTROL UNIT TO SUBSCRIBER UNIT
FIG. 3
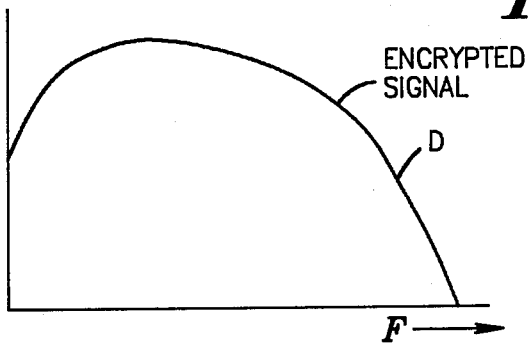
—PRIOR ART—
SECURE COMMUNICATIONS

—PRIOR ART—

SECURE TRUNKED COMMUNICATIONS SYSTEM

TECHNICAL FIELD

This invention relates generally to trunked communications systems and to secure two-way communications systems, and more particularly to apparatus and method for providing a secure trunked communications system.

BACKGROUND ART

Trunked communications systems are known in the art. Such systems typically include at least one central control unit that controls channel allocation as between various subscriber units (as used herein, "subscriber units" includes all remote transceiving devices, such as mobile units installed in vehicles, other control stations, portable devices, and RF linked telephones). To accommodate range requirements nd facilitate inter-unit communications, such systems also usually include two or more repeater stations that function to rebroadcast (or "repeat") incoming received messages on communications channels as assigned by the central control unit.

Once the central control unit has assigned a communications channel to a subscriber unit, normal voice communications can be carried out. To prevent the channel from being reassigned by the central control unit, the subscriber unit will typically transmit a subaudible connect tone (A) in parallel with the voice transmission (B) as depicted in FIG. 1. The central control unit will sense the presence of the connect tone (A) and maintain the channel assignment.

To further aid in controlling the communications process, the central control unit will continuously transmit a low speed handshake signal (C) in parallel with voice transmissions (B) as depicted in FIG. 2. The subscriber units can receive and detect this low speed handshake signal (C) and operate as desired in a predetermined fashion (for example, this signal can be used to unmute the audio processing circuitry of the subscriber units). Also, when communications are concluded, the transmitting subscriber unit transmits a disconnect signal on the communications channel to the central control unit. Upon concluding a hang-time period, the central control unit transmits a system disconnect signal to all relevant subscriber units to terminate the channel assignment.

Secure communications systems are also known in the art. Such systems typically render a voice message unintelligible to prevent unauthorized reception. To accomplish this, the voice message can be digitized and processed through an encryption device to produce a resultant signal that appears to be random (or pseudorandom) in nature. Such a signal appears like noise to unauthorized receivers and discourages intelligible reception. The particular encryption algorithm used by the encryption device may be a proprietary algorithm, or may be based on a standard such as the Data Encryption Standard promulgated by the United States National Bureau of Standards.

To date, such secure communications have only been a feature available on conventional communications systems that make use of dedicated channels. This has occurred in part because the encrypted signal itself comprises a 12 thousand bit per second (KBS) data stream (D) that requires substantially all of the available spectrum of the assigned channel as depicted in FIG. 3. Such a signal presents compatibility problems when compared to the trunked channel maintenance protocol described above, and hence a combined secure and trunked system has not been forthcoming. Conventional communications systems alone have supported secure communications needs.

Conventional channel allocation systems, however, do not represent optimum usage of increasingly crowded communications spectrum. Trunked systems are well recognized to make more efficient usage of available channel allocations. At the same time, both government and industry continue to demand greater security in their communications services. Accordingly, there exists a strongly felt need for a combined secure and trunked communications system.

SUMMARY OF THE INVENTION

The above needs and others are substantially met through provision of the secure trunked communications system disclosed herein. This system allows subscriber units to communicate on a trunked system with either standard audio transmissions or digitally encrypted audio transmissions.

To accomplish this, the invention provides for both encrypted data detectors and connect tone detectors in both the central control unit and the subscriber units. The encrypted data detector functions, in part, to provide the central control unit with a facsimile connect tone in the presence of encrypted data transmissions to allow the central control unit to perform unimpeded trunking functions such as channel assignment and maintenance. In the subscriber units, the encrypted data detectors function, in part, to enable audio processing circuitry that is ordinarily muted in the absence of a control signal from the central control unit, thereby allowing audio processing of encrypted data.

Similarly, standard trunking disconnect protocols are also accommodated to allow encrypted communications to occur without unduly extending channel assignment durations.

BRIEF DESCRIPTION OF THE DRAWINGS

These and other attributes of the invention will become more clear upon making a thorough review and study of the following description of the best mode for carrying out the invention, particularly when reviewed in conjunction with the drawings, wherein:

FIG. 1 comprises a prior art depiction of spectrum usage in subscriber unit to central controller unit communications;

FIG. 2 comprises a prior art depiction of spectrum usage in central controller unit to subscriber unit communications;

FIG. 3 comprises a prior art depiction of spectrum usage in a secure communications system;

BEST MODE FOR CARRYING OUT THE INVENTION

At the outset, certain materials of relevance are appropriate to note. These materials are published by and available from Motorola, Inc. of 1301 E. Algonquin Rd., Schaumburg, Ill. 60196, and include instruction manual 68P81066E60-A for a Trunked Radio System Central Controller, instruction manual 68P81063E20-O for a Trunked System Central Interconnect Terminal, supplement to instruction manual 68P81038E85-B for a Trunked Repeater, manual 68P81031E45-D for a Base and Repeater Station, instruction manual 68P81043E50-B for a Trunked FM Two-Way Radio, U.S. Pat. No. 3,995,225 to Horn for a Synchronous, Non Return to Zero Bit Stream Detector, U.S. Pat. No. 4,167,700 to Coe et al. for a Digital Voice Protection System and Method, U.S. Pat. No. 4,174,502 to Wilson et al. for a Delta Modulated Digital Signal Detector, U.S. Pat. No. 4,176,321 to Horn for a Delta Modulation Detector, U.S. Pat. No. 4,197,502 to Sumner et al. for a Digital Signal Detector, U.S. Pat. No. 4,440,976 to Bocci et al. for an Automatic Selection of Decryption Key for Multiple-Key encryption Systems, and U.S. Pat. No. 4,553,262 to Coe for a Communications System Enabling Radio Link Access for Non-Trunked Radio Units to a Multifrequency Trunked Two-Way Communications System. These materials are incorporated herein by reference, and will be referred to herein collectively as "the referenced materials."

Figure 4:
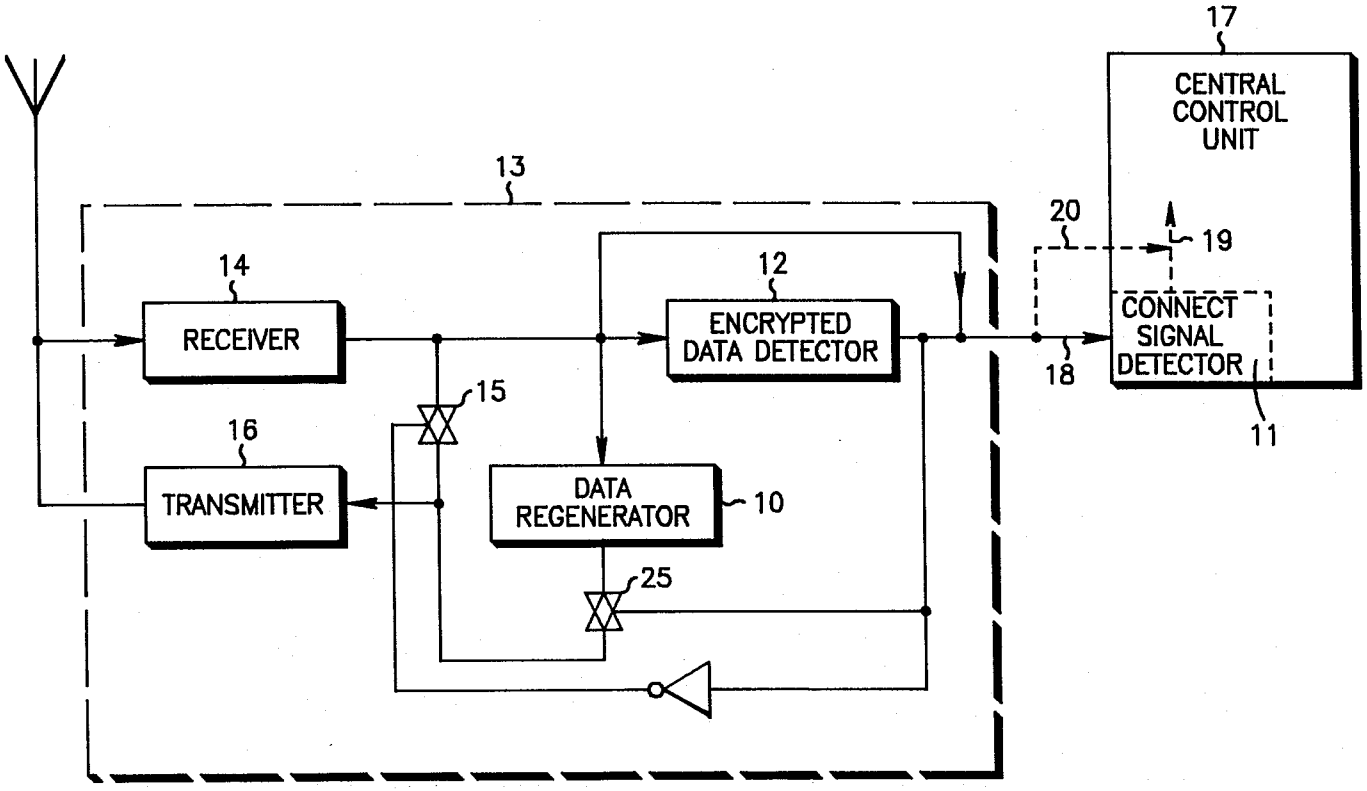
FIG. 4 comprises a block diagram depiction of a modified repeater suitable for use in the invention.

Referring now to the drawings, and particularly to FIG. 4, the invention can be seen to include generally a repeater (13) and a central control unit (17) having two detectors (11 and 12). The first detector (11) comprises a connect signal detector that detects the presence of the sub-audible connect signal (A) (FIG. 1) as provided by the subscriber unit during non-encrypted transmissions. Such a detector is set forth in the referenced materials and will typically comprise a part of the central control unit (17).

The second detector (12) comprises a data stream detector that can detect the presence of the 12 KBS data stream that comprises encrypted messages as transmitted by the subscriber units. Various embodiments of such a detector are set forth in the referenced materials, including detectors that can detect not only whether encrypted data has been received, but also whether the subscriber unit has the proper key to decode the encrypted data. Such proper code detectors have particular applicability in subscriber units as described below in more detail.

In this embodiment, the second detector (12) has been configured in conjunction with a repeater (13). The repeater (13) includes a receiver (14) and a transmitter (16) for receiving and transmitting signals from and to subscriber units. Non-data signals at the output of the receiver (14) are routed to the transmitter (16) through a gate (15) that operate under control of the encrypted data detector (12). Data signals, such as encrypted messages, are routed to the transmitter (16) through a data regenerator (10) and a second gate (25) that also responds to the encrypted data detector (12). In effect, when the encrypted data detector (12) detects a data stream, the detector (12) enables the data gate (25) and closes the non-data gate (15). Conversely, when the detector (12) does not detect data, the non-data gate (15) becomes enabled and the data path gate (25) becomes closed. Such a repeater, including the receiver and transmitter (14 and 16), is described in the referenced materials.

The repeater (13) interfaces with and operates under the control of the central control unit (17). The central control unit (17) functions, in part, to receive channel requests from subscriber units over a control channel (as described below and in the referenced materials) and to assign channels on an as-available basis to such requesting units. The central control unit (17) also functions to receive a channel-in-use signal (19) from the connect signal detector (11) to confirm that a subscriber unit is actually using the assigned channel (also as described in the referenced materials).

Pursuant to the above described structure, and in accordance with the procedures set forth below, the encrypted data detector (12) functions to detect data streams that comprise encrypted data transmissions from the subscriber units. Such transmissions will not include a connect tone signal (A) for the reasons set forth above. As a result, the connect signal detector (11) will not receive a connect tone signal and hence could not provide the channel-in-use signal (19) to the central control unit (17).

To accommodate for this, the encrypted data detector (12) provides a substitute sub-audible connect tone signal (18) to the input of the connect signal detector (11), to thereby cause the connect signal detector (11) to provide the channel-in-use signal (19) to the central control unit (17). With continued receipt of this signal (19), the central control unit (17) will maintain the channel assignment, and the encrypted communications can be carried out without interference from the central control unit (17) on the assigned trunked channel.

Figure 5:
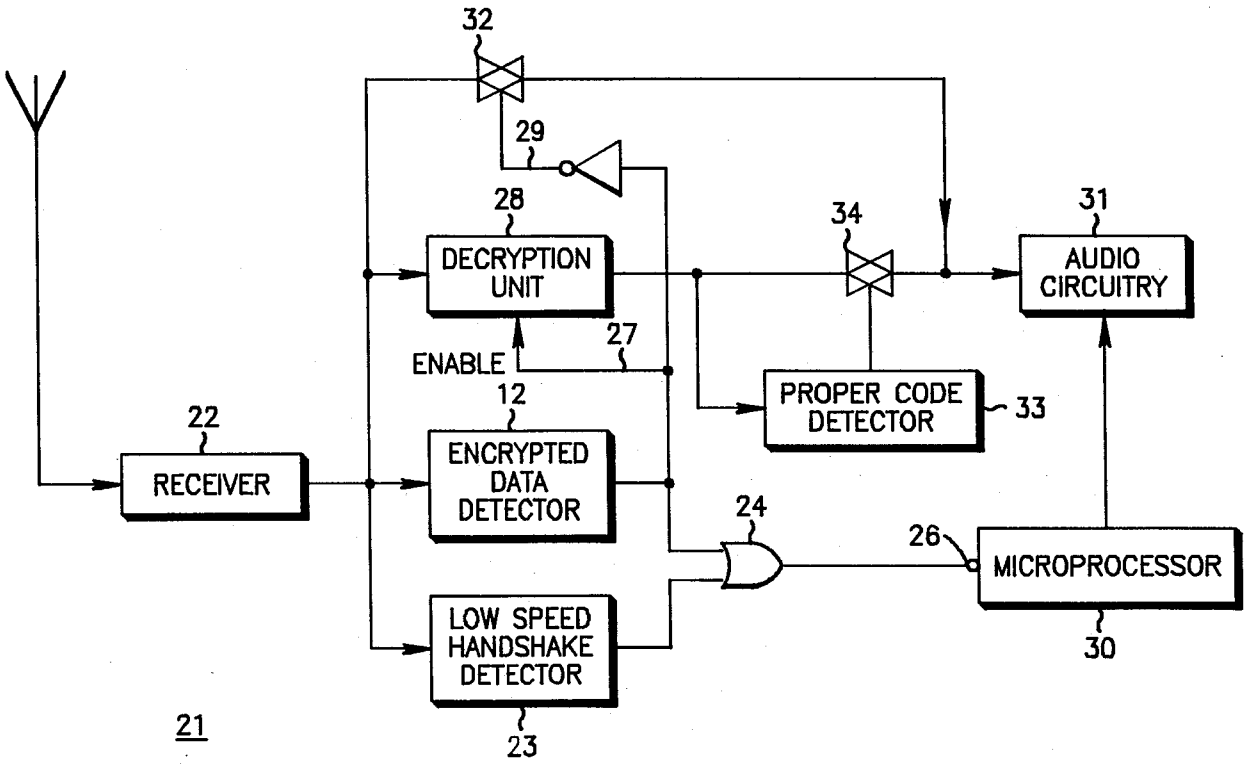
FIG. 5 comprises a block diagram depiction of a modified subscriber unit suitable for use in the invention.

Referring now to FIG. 5, a somewhat similar arrangement has been provided in the subscriber unit (21). As described in more detail in the referenced materials, the subscriber unit (21) includes a receiver (22) for receiving communications from other subscriber units via the repeater (or repeaters, as is more often the case). The output of the receiver (22) can be connected to the inputs of a lowspeed handshake detector (23) and an encrypted data detector (12) (both of which detectors are described in the referenced materials). The outputs of both detectors (12 and 23) connect to the inputs of an OR gate (24), the output (26) of which comprises an audio unmute signal that can be utilized by a microprocessor (30) in accordance with well understood prior art technique to hold the communications channel and also enable audio processing circuitry (31) to thereby render the incoming signal audible. Therefore, regardless of whether the subscriber unit (21) receives standard non-encrypted signals accompanied by a low speed handshake signal (C), or encrypted signals (D), the proper audio enabling signal will be provided for appropriate use by the subscriber unit (21).

The output of the encrypted data detector (12) also provides an enable signal (27) to a decryption unit (28) and a disable signal (29) to a gate (32) that prevents ordinary audio processing of the receiver (22) output by the audio circuitry (31), in accordance with well understood prior art technique. Further, the output of the decryption unit (28) can be provided to a proper code detector (33) as described in the referenced materials to allow control of a gate (34) in response to whether the encrypted message has been properly decrypted to thereby prevent making nonintelligible signals audible.

Figure 5A:
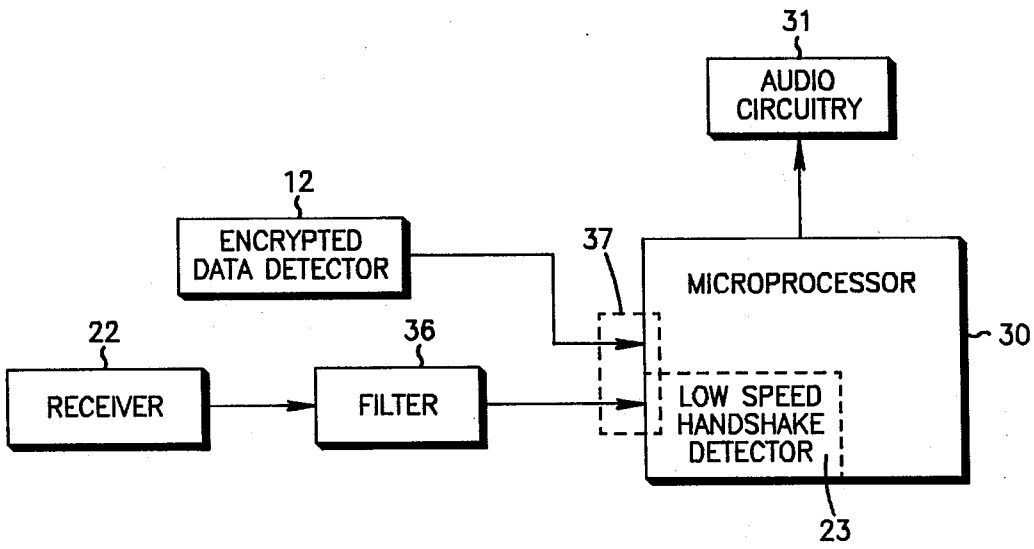
FIG 5*a* comprises a block diagram depiction of an alternative embodiment for a modified subscriber unit suitable for use in the invention.

With reference to FIG. 5*a*, an alternative embodiment for the subscriber unit will now be described, with previously described components not necessary to an understanding of the alternative embodiment being deleted.

In this embodiment, the lowspeed handshake detector (23) can be made a function of the microprocessor (30), with the receiver (22) being provided through a filter (36) to an appropriate input port of the microprocessor (30). The output of the encrypted data detector (12) can also be provided directly to an appropriate input port of the microprocessor (30). By programming the microprocessor (30) to frequently poll both inputs noted above, the microprocessor (30) essentially performs the OR function described above and as represented in FIG. 5*a* by the phantom line box denoted by the reference numeral 37. This embodiment has the advantage of minimizing parts count for the subscriber unit without unduly compromising response times.

Figure 6:
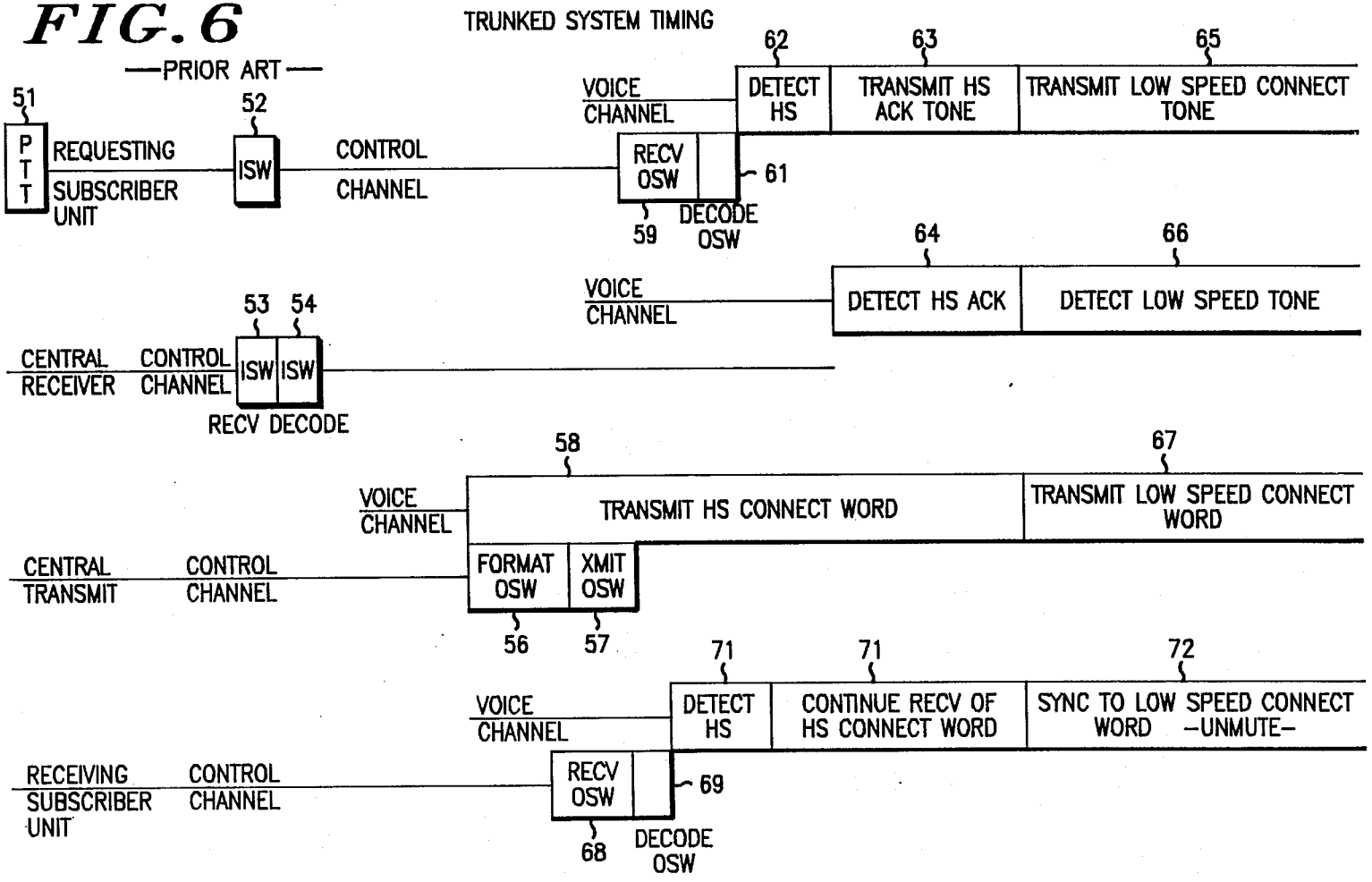
FIG. 6 comprises a time-line depiction of a prior art channel acquisition and maintenance protocol in a trunked communications system.

Referring now to FIG. 6, standard prior art channel acquisition protocol in a trunked communications system having a control channel will be described as a prelude to describing a revised acquisition protocol for use in a secure trunked communications system as described above.

To begin, a requesting subscriber unit user closes the relevant push to talk (PTT) switch (51). This causes the subscriber unit to transmit an inbound signal word (ISW) (52) on a control channel. The ISW generally includes at least a subscriber unit ID and a channel acquisition request. The central control unit receives the ISW (53) and decodes it (54). The central controller unit then prepares an appropriate outbound signalling word (OSW) (56) and transmits the OSW (57) on the control channel. This OSW generally includes at least sufficient information to assign a communications channel and to notify other subscriber units that they are requested to engage in communications on the assigned channel. Concurrent with transmission of the OSW, the central control unit also transmits a high speed connect word signal (58) on the assigned communications channel.

The requesting subscriber unit receives the OSW (59) and decodes it (61). Based upon the instructions in the OSW, the subscriber unit monitors the assigned communications channel and detects the high speed connect word signal (62). The subscriber unit then transmits a high speed acknowledgment tone (64) to the central control unit via the repeater on the communications channel, which signal is detected (65) by the central control unit. The subscriber unit then transmits a low speed connect tone (65) simultaneously with any voice communications for the duration of the transmission. So long as the central control unit continues to sense the presence of the low speed connect tone (66), the central control unit will maintain the assigned status of the communications channel. In addition, the central control unit will transmit via the repeater a low speed connect word (67) on the communications channel, for purposes described below.

The receiving subscriber units also receive the OSW (68) as transmitted by the repeater on the control channel, decode it (69), and then move to the assigned communications channel. The receiving subscriber units then monitor the communications channel for the high speed connect tone (71). Upon receiving the low speed connect word (72) as transmitted by the central control unit, the receiving subscriber units will unmute and allow transmissions from the requesting subscriber unit to be rendered audible.

Figure 7:
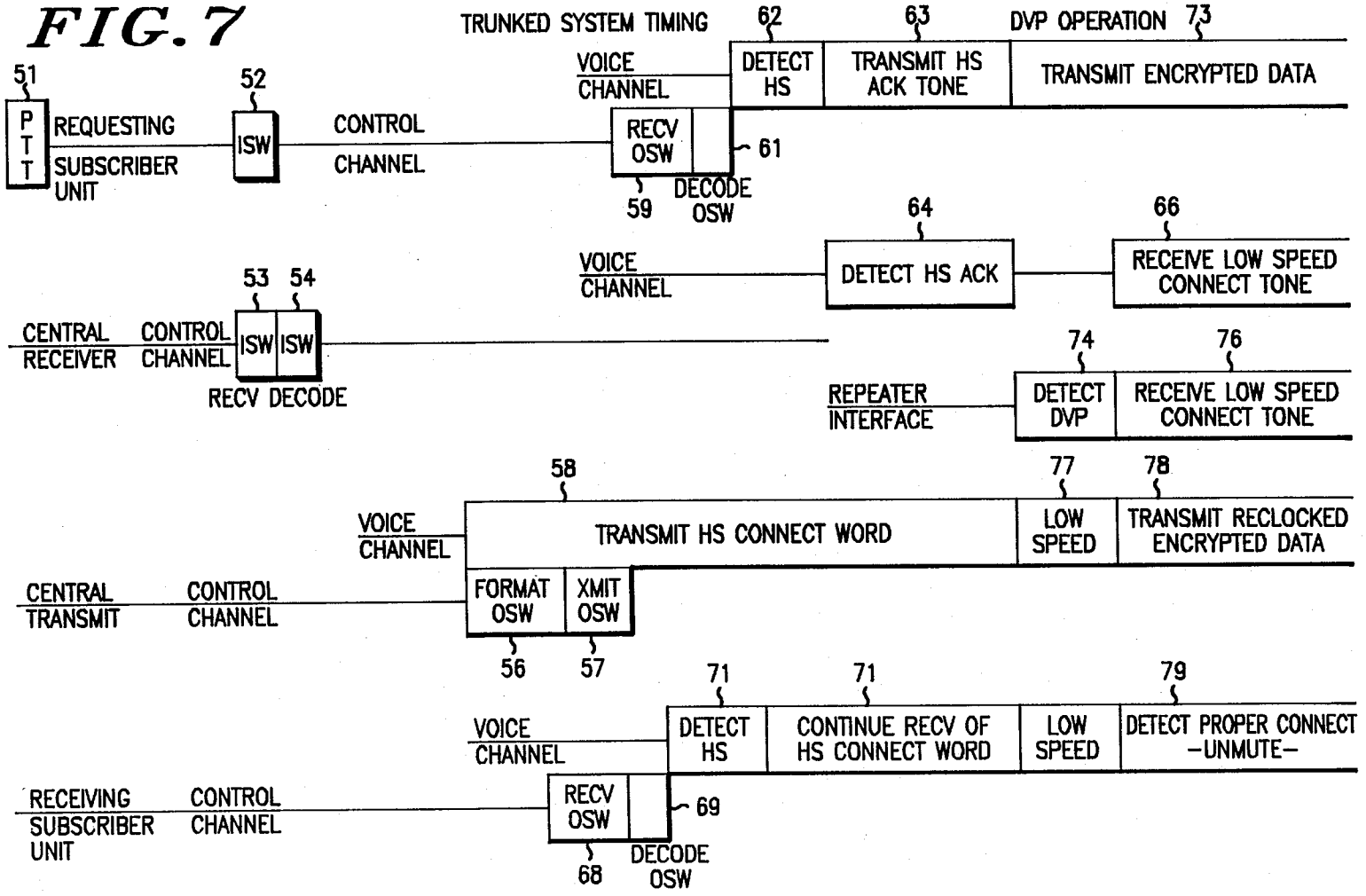
FIG. 7 comprises a time-line depiction of a modified channel acquisition and maintenance protocol for use in a secure trunked communications system.

Referring now to FIG. 7, a revised channel acquisition and maintenance protocol suitable for use in a secure trunked communications system as configured above will be described.((Much of the signalling protocol remains the same as described above, and like reference numerals are used to refer to identical functions.)

The essential trunking protocol remains the same as described above in FIG. 6, until the requesting subscriber unit transmits the high speed acknowledge tone (63). Instead of then transmitting the low speed connect tone (65) (FIG. 6), however, the requesting subscriber unit then transmits the encrypted data (73) in data stream form as described above.

The encrypted data detector (12) in the repeater interface described above detects the data stream (74) and causes a low speed connect tone to be generated (76). The central control unit then receives a low speed connect tone (66) and maintains the channel assignment. Instead of continuously transmitting the low speed connect word (77), however, the central control unit transmits the encrypted data in reclocked form (78). This retransmitted encrypted data is in turn received by the receiving subscriber units, where the encrypted data detector (12) described above for the subscriber units detects it and enables the decryption and audio processing systems (79).

In effect, secure communications can occur in a relatively transparent fashion as viewed by the central control unit. The central control unit expects to receive a low speed connect tone to facilitate normal trunking functions, and this system provides that signal during both normal and secure operations, even though transmission of such a signal is normally incompatible with standard trunking protocol spectrum usage.

Figure 8:
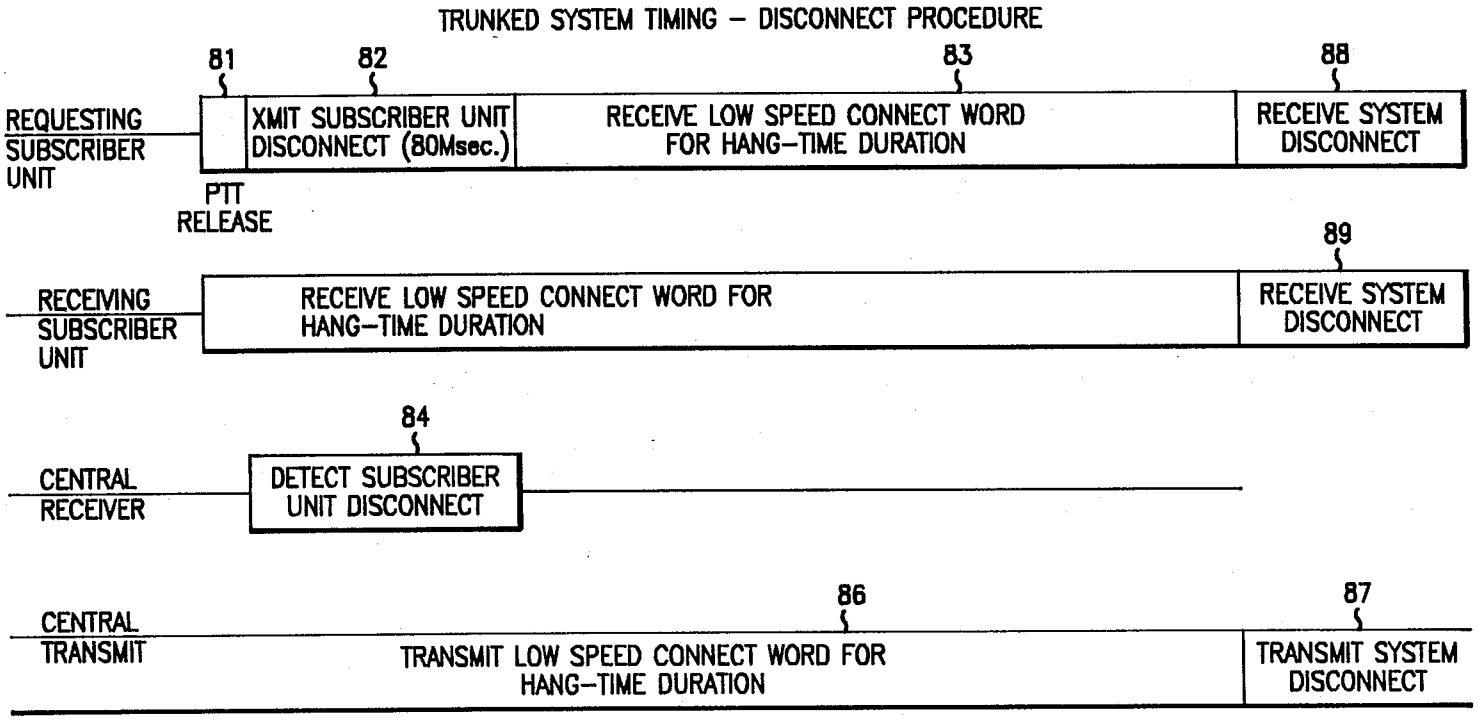
FIG. 8 comprises a time-line depiction of a prior art channel termination protocol in a trunked communications system.

Referring now to FIG. 8, a description of prior art trunking protocol disconnect procedure will be described as a prelude to describing a revised disconnect procedure for use in a secure trunked communications system as described above.

The disconnect procedure begins with the requesting subscriber unit having the PTT switch released (81). The subscriber unit then transmits a disconnect signal for a predetermined period of time (such as 80 milliseconds) and then receives the low speed connect word (83) from the central control unit for the duration of a hang-time period. The central control unit, meanwhile, receives the subscriber unit disconnect signal (84) and continues to transmit the low speed connect word until the expiration of the hang-time period (86). At the conclusion of the hang-time period, the central control unit transmits a system disconnect signal (87), which signal is received by both the requesting subscriber unit (88) and the receiving subscriber unit or units (89). The system then reverts to its pre-channel assignment status.

It should be noted that the hang-time period described above reflects description of a message trunked system. A transmission trunked system would operate substantially as described above, with the exception that no such hang-time period would be provided. Instead, the central control unit would immediately transmit a system disconnect signal (87) and all subscriber units would immediately return to monitoring the control channel. Other than this difference, a transmission trunked system could be similarly modified as described above to allow encrypted messages to be accommodated.

Figure 9:
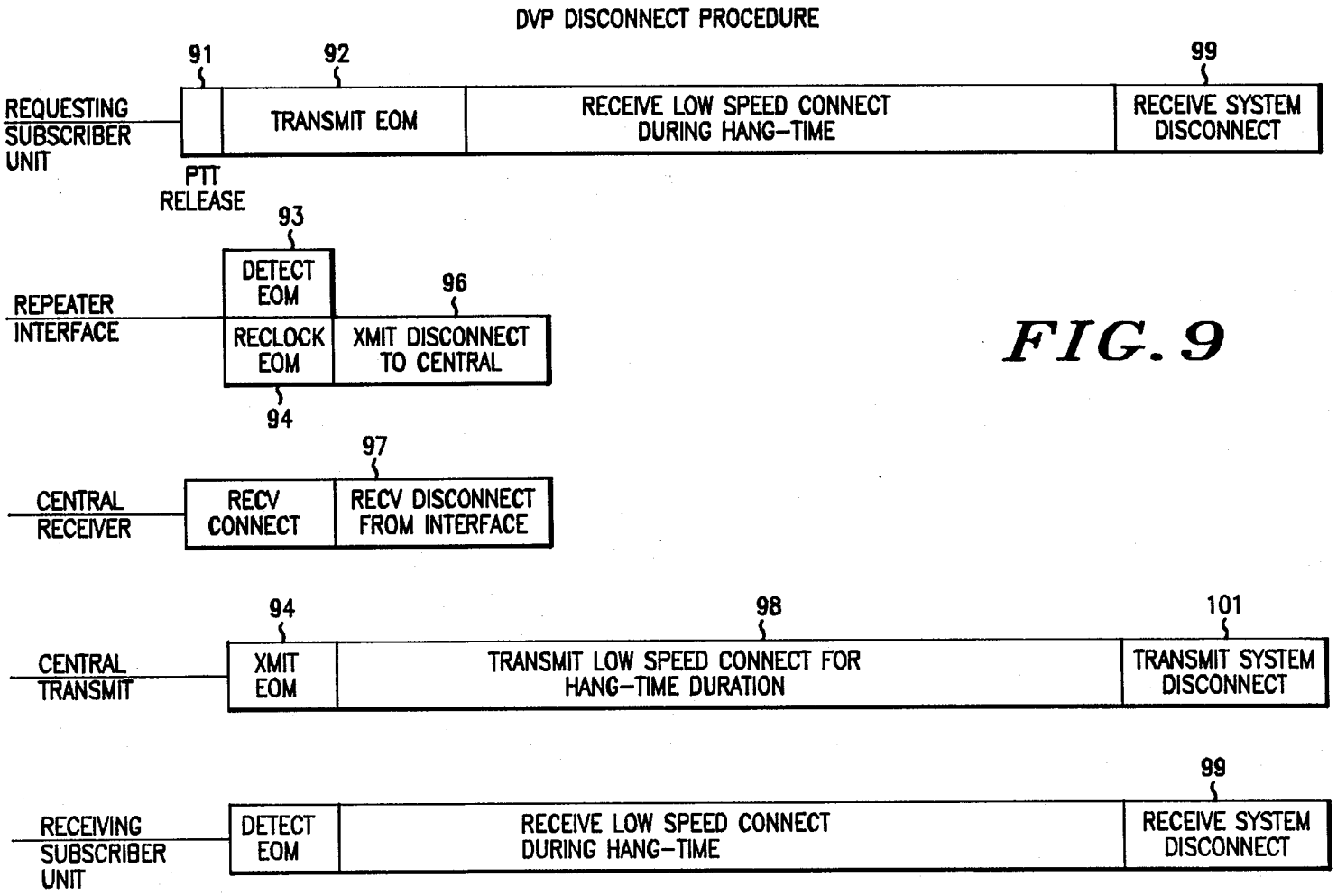
FIG. 9 comprises a time-line depiction of a modified channel termination protocol for use in a secure trunked communications system.

With reference to FIG. 9, a disconnect procedure for a secure trunked communications system as configured above will be described.

As explained above, when transmitting encrypted data, the transmitting subscriber unit transmits a data stream comprised of a 12 KBS signal. When concluding such a broadcast by release of the PTT switch (91), the transmitting subscriber unit transmits an end of message (EOM) signal (92) in this same format. Since this EOM signal is incompatible with the disconnect signal that the central control unit expects to receive, the repeater interface detects the EOM (93) and transmits a reclocked version (94) to the receiving subscriber units. The repeater interface then transmits a standard disconnect signal (96) to the central control unit. When the central control unit receives such a disconnect signal (97), it transmits the low speed connect tone for the hang-time period (98) as described above. The disconnect procedure then proceeds as described above, with all subscriber units receiving a system disconnect signal (99) as transmitted by the central control unit (101) at the conclusion of the hang-time period.

Through provision of this disconnect procedure, normal secure communications disconnect protocol can be made compatible and transparent to normal trunking disconnect protocol.

Those skilled in the art will understand and appreciate that various modifications could be made as regards the above described embodiments without departing from the spirit and scope of the inventive concept set forth. For example, with reference to FIG. 4, instead of providing a replicated connect tone (18) to the input of the connect signal detector (11), the encrypted data detector (12) could be configured to provide instead a direct replacement of the channel-in-use signal (19) as represented in phantom lines by the reference numeral 20. Therefore, it should be understood that the claims are not to be considered as being limited to the precise embodiments set forth in the absence of express limitations directed to such embodiments.

We claim:

1. A trunked radio communications system including at least one control unit and a plurality of subscriber units, wherein communications between said subscriber units occur from time to time on any one of a number of channel frequencies as assigned from time to time by said control unit on an as-available basis, wherein said communications can alternatively be both of:

audio transmissions, wherein said audio transmissions include a co-transmission of a nonaudible connect signal; and digitally encrypted audio transmissions, wherein said digitally encrypted audio transmissions are comprised of a data stream that does not include said nonaudible connect signal.

2. The trunked radio communications system of claim 1 wherein said control unit allows said communications whenever said communications includes either of said nonaudible connect signal and said data stream.

3. The trunked radio communications system of claim 2 wherein said control unit responds only to indicia of the presence of said nonaudible connect signal, and further including means for responding to presence of said data stream by providing indicia of said nonaudible connect signal to said control unit.

4. A trunked radio communications system including at least one control unit and a plurality of subscriber units, wherein communications between said subscriber units occur from time to time on any one of a number of channel frequencies as assigned from time to time by said control unit on an as-available basis, wherein said communications can alternately be both of:

audio transmissions, wherein said audio transmissions include a co-transmission of a connect signal; and digitally encrypted audio transmissions, wherein said digitally encrypted audio transmissions are comprised of a data stream that does not include a connect signal.

5. The trunked radio communications system of claim 4 wherein said control allows said communications whenever said communications includes either of said connect signal and said data stream.

6. A trunked radio communications system for selectively allowing both trunked voice communications and trunked digitally encrypted voice communications, including:

a plurality of subscriber units for originating and for receiving said normal voice communications and said digitally encrypted voice communications, wherein said originated normal voice communications include a sub-audible connect tone and said digitally encrypted voice communications are comprised of a data stream;

first detector means for detecting said sub-audible connect tone and for providing a channel-in-use signal to said central control means in response thereto;

second detector means for detecting said data stream and for causing provision of said channel-in-us signal to said central control means in response thereto; and central control means for controlling channel allocation as regards communications between said subscriber units, in response, at least in part, to said channel-in-use signal.

7. The trunked radio communications system of claim 6 wherein said received normal voice communications includes a sub-audible connect signal, and wherein said subscriber units each include third detector means for detecting said sub-audible connect signal.

8. The trunked radio communications system of claim 7 wherein said third detector means further function to selectively enable audio processing circuitry in said subscriber means.

9. In a trunked secure communication system having at least one central controller for allocating a limited number of communication channels, at least one repeater unit for receiving and broadcasting messages on said communications channels as assigned by said central controller, and a plurality of subscriber units, wherein each of said subscriber units can transmit both un-encrypted information signals that are coupled with a connect signal and encrypted information signals on any of said communication channels, a method for communicating a message containing an information signal comprising the steps of:

at any one of the plurality of subscriber units:

(a) transmitting, on a control channel, a request data signal to the central controller;

(b) receiving, on said control channel, a communication channel grant data signal from said central controller; and (c) transmitting, on said communication channel, a message alternatively comprised of both an un-encrypted information information signal together with a connect signal and an encrypted information signal;

at the central controller:

(d) receiving, on said control channel, said request data signal from said subscriber unit;

(e) transmitting, on said control channel, said communication channel grant to said subscriber unit;

(f) sensing said connect signal and maintaining said communication channel grant at least so long as said connect signal is sensed;

at the repeater:

(g) receiving said messages as transmitted on said communication channel by said subscriber unit;

(h) determining whether said message is comprised of un-encrypted information coupled with said connect signal or encrypted information;

(i) providing said connect signal to said central controller when said connect signal is received;

(j) causing, automatically, in step (f) above, said connect signal to be sensed even in the absence of said connect signal when said message comprises encrypted information;

(k) repeating at least part of said message on an allocated communication channel; and at the remaining subscriber units:

(l) receiving, on said control channel, said communication channel grant signal from the central controller;

(m) receiving a message from said communication channel in response to step (k);

(n) determining, automatically, whether said repeated message is comprised of encrypted or un-encrypted information;

(o) decrypting said message when said message is comprised of encrypted information to which the receiving subscriber unit has the key.

10. A subscriber unit for use in a secure trunked communications system, wherein the secure trunked communications system includes:

at least one central controller having: means for allocating a limited number of communication channels in response to a channel acquisition request from said subscriber unit;

means for maintaining said channel allocation, at least so long as said subscriber unit alternatively provides both of:

a connect tone in conjunction with transmission of an unencrypted signal; and an encrypted signal transmission comprised of a data stream;

means for terminating said channel allocation upon receiving either of:

a disconnect signal; and an end of message signal transmitted by said subscriber unit as part of said data stream; and means for transmitting a handshake signal when said subscriber unit transmits a signal that includes said connect tone; said subscriber unit comprising:

means for transmitting a channel allocation request to said central controller;

means for selectively transmitting a digitally encrypted message as a data stream;

means for automatically attempting to decrypt a received digitally encrypted message comprised of a data stream upon receiving such a signal, and further including means for automatically rendering a decrypted message audible following decryption;

means for automatically transmitting said connect tone in parallel with transmission of a non-encrypted message; and means for receiving a non-encrypted signal and for automatically rendering said non-encrypted message audible following receipt thereof.

11. The subscriber unit of claim 10 and further including detector means for detecting presence of said data stream and for enabling said means for automatically attempting to decrypt a received digitally encrypted message.

12. The subscriber unit of claim 10 wherein said means for automatically transmitting said connect tone in parallel with transmission of a non-encrypted message further functions to provide said disconnect signal upon concluding such a transmission.

13. The subscriber unit of claim 10 wherein said means for receiving a non-encrypted signal includes means for receiving said handshake signal to thereby enable said automatic rendering of said non-encrypted message audible.

* * * * *

UNITED STATES PATENT AND TRADEMARK OFFICE

CERTIFICATE OF CORRECTION

PATENT NO. : 4,882,751

DATED : November 21, 1989

INVENTOR(S) : Michael D. Kotzin et al.

It is certified that error appears in the above-identified patent and that said Letters Patent is hereby corrected as shown below:

Col. 8, line 40, "channel in us" should be --channel in use--.

Signed and Sealed this

Twelfth Day of February, 1991

*Attest:*

HARRY F. MANBECK, JR.

*Attesting Officer*

*Commissioner of Patents and Trademarks*